United States Patent [19]

Kyte et al.

[11] 4,381,904

[45] May 3, 1983

[54] HYDRAULIC POWER PACK

[75] Inventors: Louis D. Kyte, Garland; Malcolm N. Council, Richardson, both of Tex.

[73] Assignee: Otis Engineering Corporation, Dallas, Tex.

[21] Appl. No.: 177,527

[22] Filed: Aug. 12, 1980

[51] Int. Cl.[3] ..... F04B 49/08

[52] U.S. Cl. ..... 417/287; 417/288

[58] Field of Search ..... 417/284, 287, 288

[56] References Cited

U.S. PATENT DOCUMENTS

| | | | |
|---|---|---|---|
| 2,617,361 | 11/1952 | Neal | 417/288 |
| 3,286,636 | 11/1966 | Schaus | 417/287 X |
| 3,682,565 | 8/1972 | Yarger | 417/288 X |
| 3,995,974 | 12/1976 | Herron | 417/288 X |
| 4,199,943 | 4/1980 | Hunt | 417/288 X |

FOREIGN PATENT DOCUMENTS

| | | | |
|---|---|---|---|
| 1273947 | 7/1968 | Fed. Rep. of Germany | 417/287 |

*Primary Examiner*—Richard E. Gluck

*Attorney, Agent, or Firm*—H. Mathews Garland

[57] ABSTRACT

A hydraulic power pack for supplying hydraulic fluid under pressure for operating apparatus such as hydraulic workover units used in servicing oil and gas wells. The power pack provides substantially constant hydraulic power input to the driven apparatus over a wide range of pressures and flow rates. The power pack includes a constant speed engine, a gear box driven by the engine, a bank of positive fixed displacement pumps of varying sizes driven by the gear box and having discharge ports connected with a common discharge manifold, a hydraulic fluid reservoir, an intake manifold between the reservoir and the pumps, a return line to the reservoir, a recirculating line connected between the discharge from each of the pumps and the return line, and an unloading valve in each of the recirculating lines operable responsive to the pressure in the discharge manifold for recirculating each of the pumps to the reservoir at a predetermined pressure value. Each of the unloading valves is set to open at a different pressure ranging from a minimum at which all of the pumps discharge to the discharge manifold to a maximum above which all of the pumps recirculate to the reservoir. The unloading valves are set to operate in graduated sequence with all the pumps discharging to the manifold below a first minimum pressure with one pump automatically recirculating to the reservoir as each predetermined pressure increase increment is reached until at the last operating stage only a single pump is discharging to the manifold and above that stage all pumps recirculate to the reservoir. The power pack permits operating a hydraulic workover unit automatically providing maximum lifting force at a minimum speed to minimum lifting force at a maximum speed.

16 Claims, 3 Drawing Figures

HYDRAULIC POWER PACK

This invention relates to apparatus for supplying hydraulic pressure for operating a hydraulic piston-driven jack and the like. More particularly this invention relates to a hydraulic power pack for driving hydraulic jacks.

Hydraulic apparatus such as jacks are used in the oil and gas industry for drilling wells and for the servicing of wells including the running and pulling of drill pipe, production tubing, and the like. Such equipment is more commonly known in the industry by the terms "hydraulic workover units." Hydraulic workover units include cylinder-piston assemblies having cylinder and piston ends into which hydraulic fluid is forced under pressure for purposes of raising and lowering a piston connected with a structure such as slips for holding the pipe as the pipe is raised and lowered in a well bore. The load demands when running and when pulling a string of pipe vary over a wide range. As a string of pipe is run into a well bore, the weight of the pipe string increases progressively as joints of pipe are added into the string. Similarly, as a string of pipe is pulled from a well bore, the force required to lift the pipe string decreases as the pipe is lifted and joints are sequentially removed from the string at the surface. When a string of pipe is run into a well bore under pressure, commonly referred to as "snubbing," the initial force required to insert the first joints of pipe may be quite high and progressively decreases as the joints are added increasing the weight of the string. A point may be reached at which the string of pipe exerts a force which exceeds the force of the well pressure tending to push the pipe out of the well bore. In order to achieve most efficient operation, it is preferred when using prime movers such as diesel engines that the engines be run at the constant speed with an effort being made to achieve a constant power input to the workover unit over as wide a range as possible. By so doing, when the pipe is being handled under light load conditions, both during the time of pulling pipe and when snubbing pipe into a well under pressure, the pipe may be moved at high rates when the load demands are low and at lower rates when the load demands are high. A workover unit is most efficiently operated when this can be achieved reducing the time required as well as the energy needed to run and pull pipe. With the extreme cost of drilling and servicing wells, any reduction in energy and time is worth achieving. The power demands of a hydraulic workover unit may be correlated with engine output by using either variable output hydraulic pumps or fixed displacement pumps. In the past, the proper balance between engine output and hydraulic power need has been most easily achieved by the use of variable volume pumps. Variable volume pumps are, however, more expensive type of equipment; they are more expensive to maintain; and they require more highly trained personnel. In the past, an approach has been made toward using fixed volume pumps which are operated in a discharge sequence controlled by a relief valve which discharges one pump at a lower pressure while continuing the operation of a higher pressure pump. So far as is presently known, however, a manual relief valve is employed with only two pumps thereby precluding a smooth automatic uniform application of power over a wide range of speeds and load demands.

It is the principal object of the present invention to provide a new and improved hydraulic power pack for operating apparatus such as hydraulic workover units.

It is another object of the invention to provide a hydraulic power pack which utilizes fixed output pumps.

It is another object of the invention to provide a hydraulic power pack capable of providing a substantially uniform hydraulic power output over a wide range of pressure-discharge rate combinations.

It is another object of the invention to provide a hydraulic power pack which automatically varies the discharge rate and pressure of the pack responsive to hydraulic pressure demands of the apparatus operated by the power pack.

It is another object of the invention to provide a hydraulic power pack for operating apparatus such as hydraulic workover units wherein unloading valves connected between hydraulic pumps and the fluid reservoir are sequentially operated responsive to pressure demands for connecting and disconnecting the pumps at various pressures with a discharge manifold from the power pack.

It is another object of the invention to provide a hydraulic power pack having a multiple stage output capable of automatically delivering hydraulic fluid over a wide range of pressure and discharge rate combinations.

It is another object of the invention to provide a hydraulic power pack for operating a hydraulic workover unit in which the speed of running a string of pipe into and out of a well bore automatically varies in direct inverse relationship to the load requirements of the system.

It is another object of the invention to provide a hydraulic power pack which has both lower initial and maintenance costs.

It is another object of the invention to provide a hydraulic power pack which utilizes fixed displacement pumps having greater reliability than currently used variable volume pumps.

In accordance with the present invention, there is provided a hydraulic power pack which includes a bank of fixed displacement hydraulic pumps having inlets connected with a common reservoir and outlets connected with a common discharge manifold, and separate unloading valves connected between the outlet of each of the pumps and the common reservoir. The unloading valves are operable responsive to different discharge manifold pressures whereby the pump discharges are sequentially connected and disconnected with the common reservoir as pressure changes occur in the discharge manifold providing maximum flow rate from all pumps in the discharge manifold at a predetermined low pressure and minimum discharge rate into the discharge manifold at a predetermined maximum pressure. The flow rate into the discharge manifold is automatically sequentially reduced in increments as the pressure in the discharge manifold increases from a predetermined minimum to a predetermined maximum.

The foregoing objects and advantages of the invention as well as the specific details of a preferred embodiment thereof will be better understood from the following detailed description taken in conjunction with the accompanying drawings wherein.

Figure 1:
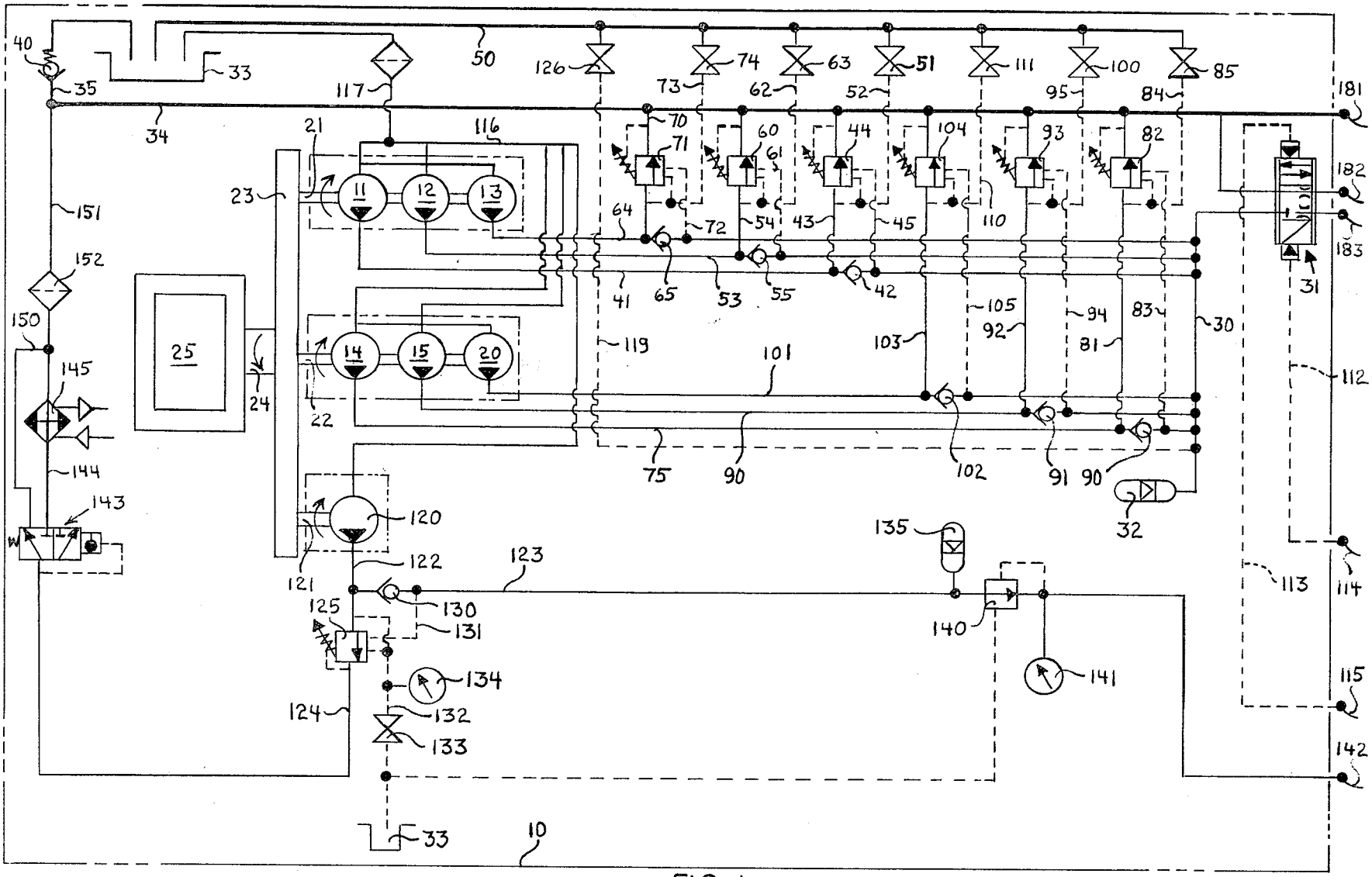
FIG. 1 is a schematic view of the hydraulic circuitry of the power pack of the invention.

Referring to FIG. 1 of the drawings, a power pack 10 embodying the features of the invention includes two banks of positive displacement fixed volume pumps 11, 12, 13, 14, 15, and 20. The pumps are arranged in two banks with pumps 11–13 in one bank and pumps 14, 15, and 20 in a second bank. The pumps 11–13 are driven by a shaft 21 and the pumps 14–20 similarly are driven by another shaft 22. The shafts 21 and 22 are connected with a gear box 23 having a central drive shaft 24 driven by a diesel engine 25. The pumps, gear box, and engine are suitable standard units. The pumps are preferably gear-type pumps fitted to be coupled directly together providing a compact pump assembly in which all of the pumps are driven simultaneously by the gear box. The diesel engine is preferably fitted to run at a constant speed such as 1800 rpm. The pumps are preferably of different capacities determined by the particular needs of the hydraulic system such as the workover unit to be powered by the power pack. In one typical application of the power pack, a diesel engine was selected to deliver a substantially constant horsepower of approximately 225. The pumps were selected to operate over a pressure range from approximately 1300 psi to 3500 psi with all six pumps operating at the lower pressure and a single pump in operation at the highest pressure. The pumps were sized in pairs. Pumps 11 and 14 delivered 52.39 gallons per minute; pumps 12 and 15 delivered 41.69 gallons per minute; and pumps 13 and 20 each had a capacity of 31.65 gallons per minute.

Each of the pumps 11–13, 14, 15 and 20 is connected to an individual discharge line leading to a pump discharge manifold 30 which connects at one end with a remotely controlled directional and flow control valve 31 and at the opposite end with a gas charged accumulator 32. The power pack includes a hydraulic fluid reservoir 33 and a hydraulic fluid return line 34 which connects at one end into a line 35 leading to the reservoir and including a back pressure check valve 40. Each of the pump discharge lines is connected through an unloading valve to the return line 34 for recirculating the discharge from each of the pumps back to the reservoir when pressure conditions are such that it is not desired that the discharge be delivered from the power pack to the hydraulic unit such as a workover unit being powered by the pack. More particularly, the pump 11 has a discharge line 41 which connects the pump discharge to the manifold 30. A check valve 42 is included in the line 41 between the pump and the manifold to prevent the flow from the manifold to the pump in the line 41. A pump recirculating line 43 is connected from the discharge line 41 between the pump 11 and the check valve 42 across to the hydraulic return line 34 for recirculating discharge from the pump 11 to the return line. The line 43 includes an unloading valve 44 which is a spring-loaded valve for controlling recirculating flow from the pump 11 through the line 41 upstream of the check valve 42 across in the line 43 to the return line 34. A pilot pressure line 45 connects the unloading valve 44 with the discharge line 41 at a location between the manifold 30 and the check valve 42 so that a predetermined pressure in the discharge line down the stream from the check valve 42 opens the valve 44 to recirculate the discharge from the pump 11 back to the return line 34. All of the pumps are arranged to be unloaded for purposes of starting the engine and pumps. For this purpose, a vent or dump pressure line 50 is connected at one end into the reservoir 33. With respect to pump 11, a hand-operated valve 51 is connected in a pilot line 52 extending to the unloading valve 44 and the recirculating line 43 for purposes of manually recirculating the pump 11 when starting the engines and pumps. The unloading valve 44 is held closed by fluid pressure from the line 43 which can be bled off to the tank 33 through the line 52 and the manual valve 51 permitting the pump 11 to recirculate to the tank when the engine and pumps are started. Further, the unloading valve can be opened by a predetermined high pressure applied through the line 45 from the discharge line 41 from the pump downstream of the check valve 42. This arrangement permits unloading the pumps for start-up and then thereafter permits unloading and recirculating the pumps responsive to the predetermined high pressure in the manifold 30 as applied back toward each pump in the discharge line from the manifold.

The other pumps 12, 13, 14, 15, and 20 are connected in exactly the same manner with the tank 33 and with the discharge manifold 30 as explained with respect to the pump 11. Specifically, the pump 12 is connected with a discharge line 53 leading to the manifold 30. Recirculating line 54 runs from the line 53 to the return line 34 downstream from a check valve 55 in the line 53. An unloading valve 60 is in the line 54 connected by a pilot line 61 with the discharge line 53 downstream from the check valve 55. A bleed line 62 including a manual valve 63 is connected from the line 50 to the tank to the unloading valve 60 and the line 54 upstream from the unloading valve. Similarly, the pump 13 has a discharge line 64 extending to the manifold 30 including a check valve 65 between the pump and the manifold. A recirculating line 70 including an unloading valve 71 is connected between the discharge line 64 and the return line 34. A pilot line 72 runs from the line 64 downstream of the check valve 65 into the unloading valve 71 for recirculating the pump 13 responsive to a high pressure in the discharge line 64. A vent line 73 having a manual valve 74 is connected from the unloading valve 71 and the line 70 upstream of the unloading valve into the line 50 to the tank 33 for recirculating the pump 13 upon start-up. The pump 14 has a discharge line 75 including a check valve 80 leading to the manifold 30. A recirculating line 81 is connected from the discharge line 75 upstream from the check valve 80 into the return line 34. An unloading valve 82 is connected in the recirculating line 81 having a high pressure pilot control line 83 leading into discharge line 75 downstream from the check valve 80 for opening the unloading valve 82 in response to a high pressure between the check valve 80 and manifold 30. A bleed line 84 including a manual valve 85 is connected from the line 50 to the tank into the unloading valve 82 and the recirculating line 81 for opening the unloading valve when starting the engine and pumps. The pump 15 has a discharge line 90 including a check valve 91 leading from the pump to the discharge manifold 30. A recirculating line 92 including an unloading valve 93 is connected from the discharge line 90 upstream from the check valve 91 across to the return line 34 for recirculating the pump 15 responsive to a predetermined high pressure. A pilot line 94 from the unloading valve 93 into the discharge line 90 between the manifold 30 and the check valve 91 controls the opening of the unloading valve 93 in response to a high pressure in the discharge manifold. A bleed line 95 including a manual valve 100 is connected from the line 50 to the tank into the recirculating line 92 and the unloading valve 93 for opening the unloading valve during start-up of the engine and pumps. The pump 20 is connected with a discharge line 101 including a check valve 102 and leading to the manifold 30. A recirculating line 103 extends from the line 101 upstream from the check valve to the return line 34. A pilot line 105 runs from the discharge line 101 downstream from the check valve 102 into the unloading valve 104 for opening the unloading valve responsive to a predetermined high pressure. A bleed line 110 including a hand-operated valve 111 extends from the line 50 leading to the reservoir 33 into the unloading valve 104 and the recirculating line 103 for the purpose of opening the unloading valve during start-up of the engine and pumps.

The intake ports of all of the pumps are connected with an intake manifold 116 leading to an intake line 117 extending through a filter 118 to the reservoir 33. A line 119 having a hand valve 126 connects the discharge manifold 30 with the line 50 to the reservoir.

The unloading valves 44, 60, 71, 82, 93, and 104 which sequentially control the delivery of hydraulic fluid under pressure from the pumps and the recirculation of the pumps are set to operate at the different pressures for delivering hydraulic fluid to the discharge manifold in a volume and at pressures which produce a substantially uniform power capability over a fairly wide range. With the particular six pumps previously described and utilizing the substantially constant horsepower of approximately 225, the unloading valves were set to recirculate to the pumps in accordance with the following pressure settings for the valves: valve 82—1300 psi; valve 60—1600 psi; valve 93—2050 psi; valve 71—2800 psi; valve 44—3250 psi; and valve 104—3500 psi. With this combination of pressure settings on the unloading valves, the pump 13 begins recirculating to the reservoir 33 at 1300 psi; the pump 12 at 1600 psi; the pump 15 at 2050 psi; the pump 13 at 2800 psi; the pump 11 at 3250 psi; and the pump 20 at 3500 psi.

Figure 2:
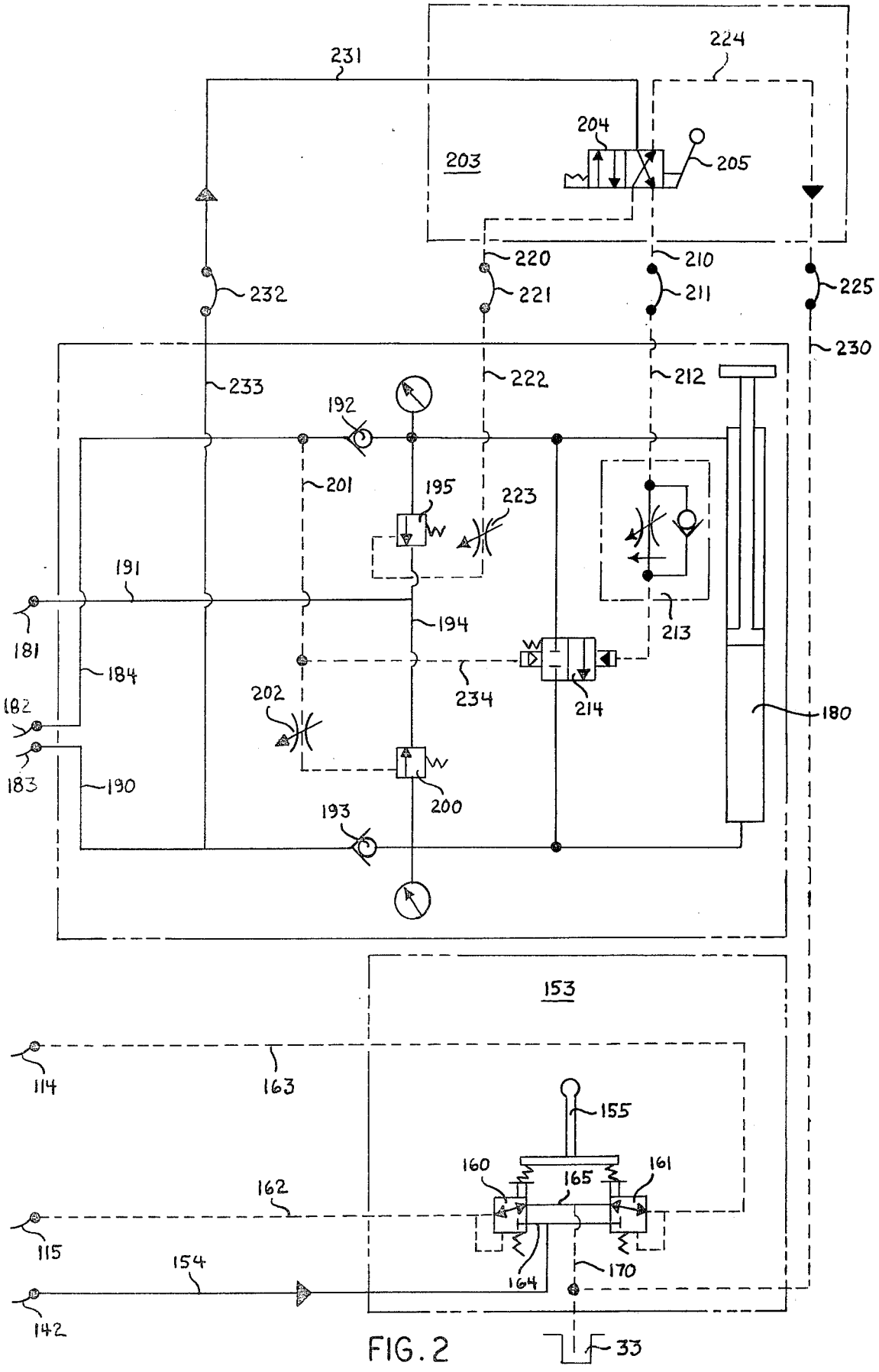
FIG. 2 is a schematic view of the hydraulic circuitry of the jack apparatus of a hydraulic workover unit and the controls for the unit.

The directional and flow control valve 31 is operated by pilot lines 112 and 113 leading to a control valve assembly illustrated in FIG. 2 to be described in detail hereinafter. The ends of the fluid control lines or pilot lines 112 and 113 are provided with fittings for the connection of flexible hoses 114 and 115 respectively. The remote directional control valve circuitry of FIG. 2 is provided with fluid operating pressure by a fixed displacement type gear pump 120 and connected with the gear box 23 by a shaft 121. A discharge line 122 is connected with the pump 120 at one end and at the other end is connected with a supply line 123 for the directional control valve system and a recirculating line 124 which includes an unloading valve 125. A check valve 130 is included in the supply line 123. Downstream from the check valve 130 a pilot line 131 is connected from the line 123 into the unloading valve 125 for opening the unloading valve in response to the predetermined pressure in the supply line 123 downstream from the check valve. A bleed line 132 including a manual valve 133 and a gauge 134 extends from the reservoir 33 to the unloading valve 125 and the line 122 upstream from the unloading valve so that the unloading valve may be vented to the reservoir to open the valve during the start-up of the engine and pumps. An accumulator 135 is connected into the supply line 123 to provide a constant supply of control fluid pressure to the remote directional control valve system. A pressure reducing valve 140 is connected in the line 123 downstream from the accumulator. A pressure gauge 141 is connected in the line 123 downstream from the pressure reducing valve. The free end of the supply line 123 is provided with a fitting for the connection of a flexible hose 142 leading to the remote directional control valve system.

The recirculating line 124 from the pump 120 is connected into a thermostatically controlled directional valve 143 which connects with a line 144 leading to a heat exchanger 145 and a bypass line 150 connected around the heat exchanger into a line 151 extending from the discharge of the heat exchanger to the line 35 leading to the reservoir 33 through the check valve 40. The line 151 includes a filter 152. Below a predetermined temperature, the valve 143 directs the hydraulic fluid around the heat exchanger 145. When the hydraulic fluid is above the temperature, the fluid is directed through the line 144 to the heat exchanger which cools the fluid after which it is discharged through the filter for cleaning and thereafter in the line 151 back to the reservoir.

Referring to FIG. 2, a remote directional control valve assembly 153 is provided with a supply line 154 connected by the flexible hose 142 with the fluid pressure supply line 123 from the pump 120. The control valve assembly 153 has a control lever 155 which operates a pair of two-position pressure reducing valves 160 and 161. The valve 160 is connected on one side with a line 162 leading to the flexible hose 115 connected with the pilot line 113 extending to the power pack directional control valve 31. Similarly, one side of the valve 161 is connected with a line 163 leading to the flexible hose 114 which is coupled into the pilot line 112 extending to the directional control valve 31 on the power pack. The other sides of the valve 160 and 161 each have two ports, one of which is connected with a line 164 leading to the control fluid supply line 154 and the other port of which is connected with a line 165 which connects into a drain line 170 leading back to the reservoir 33. Thus at the one position each of the valves 160 and 161 provides a control fluid pressure from the supply line 154 into one of the pilot lines 112 and 113 to the power pack valve 31. At the other position of valves 160 and 161, they each connect the respective pilot lines with the drain back to the reservoir 33. Thus, when the pilot line 112 to the valve 31 is pressured the valve 113 extending from the other side of the valve 31 is drained back to the reservoir. Similarly, when the pilot line 113 is pressured the pilot line 112 is drained back to the reservoir.

Further, referring to FIG. 2, a hydraulic jack assembly 180 schematically representing a hydraulic workover unit, is connected with the power pack 10 of FIG. 1 by flexible hose connections 181, 182, and 183 which lead to the hydraulic fluid return line 34 of the power pack and the directional and flow control valve 31 of the power pack. The flexible hoses 182 and 183 connect, respectively, with a line 184 leading to the rod end of the jack 180 and a line 190 to the piston end of the jack. The flexible hose 181 connects with a return line 191 which is selectively communicated with either end of the cylinder of the jack depending upon the direction of movement of the piston and rod. The line 184 leading to the rod end of the jack includes a check valve 192.

Similarly, line 190 leading to the piston end of the jack includes a check valve 193. A return line 194 is connected at opposite ends into the lines 184 and 190 toward the jack from the check valves 192 and 193. The return line 194 includes spaced counterbalance valves 195 and 200. The return line 191 connects into the return line 194 between the counterbalance valves. A pilot line 201 including a variable restriction 202 is connected from the line 184 upstream from the check valve 192 into the counterbalance valve 200 to ensure that the counterbalance valve is open only when there is a pressure in the line 184. The restriction 202 is adjustable to permit control of chatter in the counterbalance valve. This arrangement for operation of the counterbalance valve ensures against inadvertent uncontrolled dropping of the jack when the supply lines are not under pressure.

The hydraulic circuitry of the jack 180 provides for regenerative operation of the jack in which the return fluid from the rod end of the cylinder is recirculated back into the piston end during the lifting of the jack which is a technique for increasing the jack speed under lower load conditions by simply redirecting the flow of the hydraulic fluid. Recirculating the fluid from the rod end to the piston end of the jack cylinder effectively reduces the lifting area of the piston to the diameter of the rod because the pressure of the fluid being forced into the piston end is also applied in the rod end over the annular area of the top of the piston around the rod. The regenerative operation is controlled by a regenerative speed select valve assembly 203 which includes a two-position valve 204 operated by a hand lever 205. The valve assembly 203 is connected with the jack by flexible lines so that the valve assembly may be located at a control station with the valve assembly 153. The valve 205 is connected by a pilot line 210 to a flexible hose 211 extending to a pilot line 212 which connects through a flow control valve 213 into a two-way valve 214 in a line 215 extending between the lines 184 and 190 to provide communication between the rod and piston ends of the jack when the jack is in the regenerative mode of operation. When the valve 214 is open, fluid may flow from the rod end around through the line 215 into the piston end of the jack. When the valve 214 is closed, the rod and piston ends are fully isolated from each other. A pilot line 220 extends from the valve 204 to a flexible connection 221 leading to a pilot line 222 extending to the counterbalance valve 195. The line 222 has a variable restriction 223 for control of chatter in the counterbalance valve. A vent or drain line 224 extends from the valve 204 to a flexible hose 225 connected with a line 230 leading through the line 170 at the valve assembly 153 to the tank 33 for draining the pilot line leading to the counterbalance valve 195 so that during the regenerative mode the counterbalance valve remains closed while the hydraulic flow is directed from the rod around to the piston end of the jack. A pilot line 231 is connected to the valve 204 through a flexible hose 232 to a pilot line 233 connected into the line 190 upstream from the check valve 193 for supplying pilot pressure from the line 190 through the valve 204 into the counterbalance valve 195 during non-regenerative lifting of the jack to permit a return of the hydraulic fluid from the piston end of the jack into the return line 191. At one position of the lever 205 on the valve 204 for the regenerative mode the pilot line 212 is pressurized opening the valve 214 while the pilot line 222 to the counterbalance valve 195 is communicated through the lines 224 and 230 to the reservoir so that there is no pressure holding the counterbalance valve open and the jack is operated in the regenerative mode. At the other position of the regenerative valve lever 205 when the jack is not operated in the regenerative mode pilot pressure from line 190 through the lines 233, 220, and 222 the counterbalance valve 195 is held open while the pilot lines 210 and 212 leading to the regenerative recirculation valve 214 is communicated to the reservoir and the valve 214 is closed. A pilot line 234 leads from the pilot line 201 into the valve 214 further ensuring that the valve 214 is closed when the rod end of the jack is pressurized such as when snubbing a pipe string into a well bore under pressure. Obviously, the regenerative mode cannot be used when forcing the piston downwardly because the pressure over the bottom of the piston and around the rod over the top of the piston simultaneously would cause the piston to move back upwardly.

The operation of the power pack 10 shall be described in terms of providing hydraulic fluid pressure to the jack 180 for purposes of operating the jack as when the jack is part of a hydraulic workover unit for running and pulling pipe strings in oil and gas wells. It is to be understood however that the use of the power unit 10 is not limited to a particular hydraulically powered apparatus though it is especially useful with hydraulic workover units. The pumps 11–15, 20, and 120 are all directly coupled to the gear box 23 with the engine 25 so that all of the pumps start when the engine is started. To avoid immediate pressure build-up by the pumps before the engine is up to operating speed, the discharge from all of the pumps is recirculated to the reservoir 33 when starting the engine. The vent valves 74, 63, 51, 111, 100, 85, and 133 are all opened so that the unloading valves associated with each of the pumps are each open recirculating all of the pumps back to the reservoir 33. For example, when the valve 74 is opened the line 73 vents the unloading valve 71 to the reservoir 33 through the line 50. With the unloading valve vented and the valve is open so that the pump 13 discharging through the line 64 recirculates the hydraulic fluid discharge from the pump through the line 70 and the unloading valve to the return line 34. The hydraulic fluid flows from the return line through line 35, the check valve 40 and back into the reservoir 33. The pump is pulling hydraulic fluid from the reservoir through the filtered line 117 into the intake manifold 116 connected with all of the pumps. During the starting of the engine and pumps, each of the pumps pulls hydraulic fluid from the reservoir 33 pumping the fluid into the discharge line connected with the pump and recirculating the fluid back to the reservoir 33 through the particular recirculating line and unloading valve associated with the pump. With all of the pumps recirculating to the reservoir, the engine is brought up to a normal constant operating speed which may, for example, be 1800 rpm. The vent valves associated with all of the pumps may then be closed so that each of the pumps no longer recirculates directly to the reservoir. The hydraulic fluid discharged from the pumps 11–15 and 20 is delivered through the discharge lines connected with the pumps into the discharge manifold 30. Presuming the directional and flow control valve 31 controlling the discharge from the power pack is closed, the pressure rapidly builds in the discharge lines and discharge manifold charging the accumulator 32. The discharge from the pump 120 supplying hydraulic fluid to the remote directional control valve assembly 153 flows through the discharge line 122, the check valve 130, the line 123, the valve 140, and through the flexible hose 142 to the supply line for the valve assembly 153 through which the fluid flows to the line 164 between the two valves 160 and 161 of the valve assembly 153. The accumulator 135 is charged from the line 123. When the desired pressure value for control circuitry is reached, the accumulator 135 is fully charged and the pressure communicated through the pilot line 131 to the unloading valve 125 opens the unloading valve directing the discharge hydraulic fluid from the pump 120 through the unloading valve into the recirculating line 124. The recirculating hydraulic fluid passes through the thermostatically controlled valve 143 which directs the fluid into the line 144 to the heat exchanger 145 of the temperature of the fluid is sufficiently high that it requires cooling, or, alternatively, if the temperature of the fluid is below the level required for cooling it is directed into the line 150. The recirculating fluid then flows from either the heat exchanger or the line 150 through the filter 152 into the line 151. The flow from the line 151 passes through the check valve 40 back into the reservoir 33. The control fluid flows from the valve assembly 153 through the pilot lines 162 and 163, the flexible hoses 114 and 115, and then into the lines 112 and 113 to the directional flow control valve 31. Of course, at the neutral position of the lever 155 on the valve assembly 153 shown in FIG. 2, fluid pressure is not supplied to the valve 31 so that the valve 31 remains closed. As leakage and, or, flow of the hydraulic control fluid operating the valve 31 from the valve assembly 153 depletes the accumulator 135 to a level below the setting of the unloading valve 125, the unloading valve is closed so that the pump 120 again delivers hydraulic control fluid into the line 123.

Figure 3:
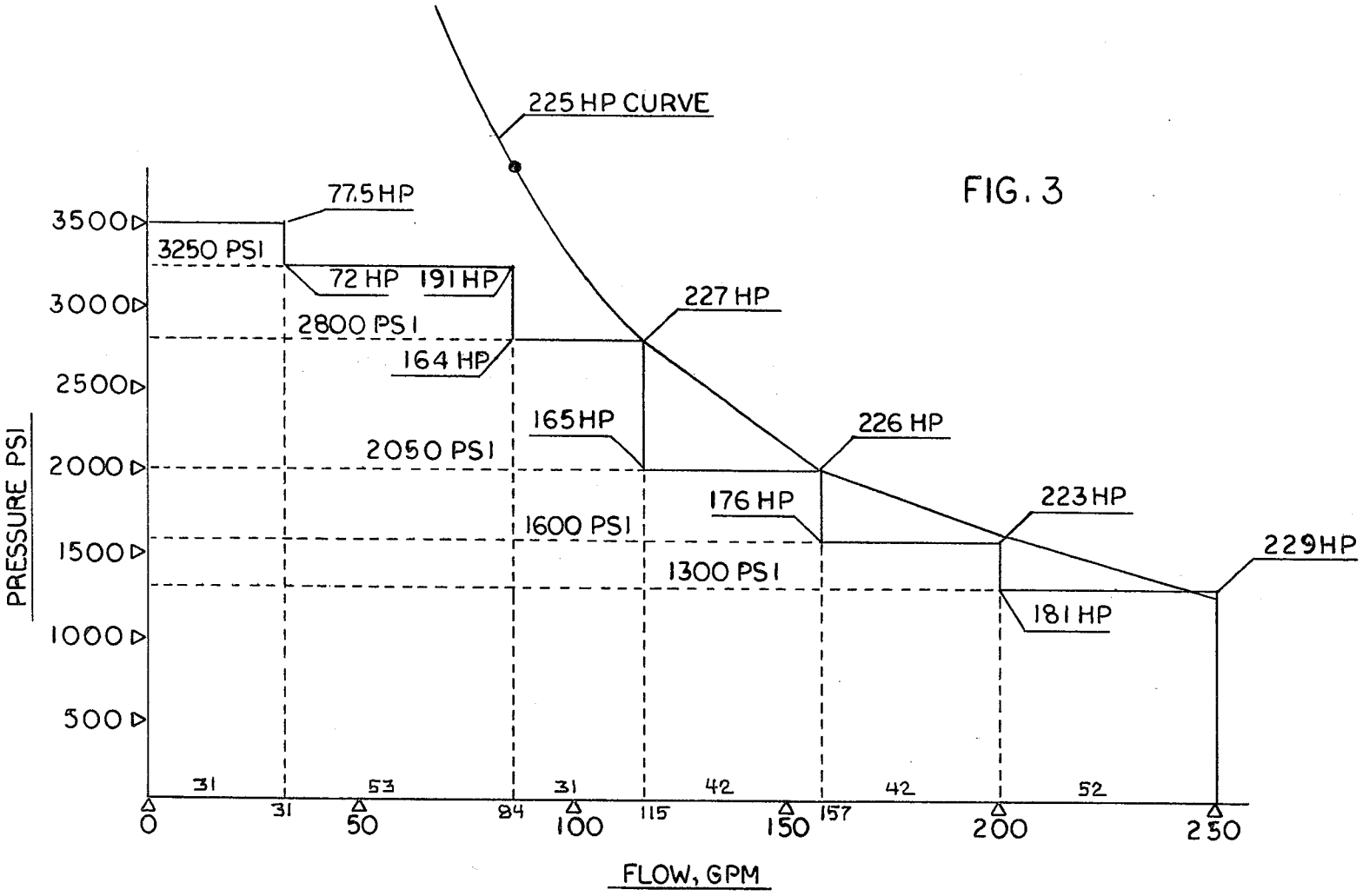
FIG. 3 is a graph showing the relationship between the fluid pressure and discharge rate of the power pack with varying numbers of the pumps operating.

With the engine 25 operating at normal speed and all of the pumps delivering into the discharge manifold 30 leading to the valve 31, and presuming the valve 31 is closed, all six pumps 11–15 and 20 are delivering total pump capacity into the discharge manifold. The pressure rapidly increases in the discharge manifold whereby the automatic control features of the power pack begin to operate. FIG. 3 demonstrates the operation of the power pack in terms the pressures and flow rates delivered by the unit over the range of the various pump combinations available. Also FIG. 3 shows the horsepower available from the power pack during the operation of various pump combinations and including particularly the range over which a substantially constant horsepower is obtainable at different pressures and flow rates. Referring particularly to FIG. 3, when all of the pumps initially start discharging hydraulic fluid into the discharge manifold 30 the sum of the capacities of the pumps and thus the maximum flow rate capability of the power pack is approximately 250 gpm as shown in terms of the delivery capacity of each of the individual pumps. Thus, immediately after all of the pumps are discharging into the discharge manifold the total discharge capacity of about 250 gallons comprises the discharge of all six pumps which are in operation. The pressure rapidly builds to 1300 psi at which level the unloading valve 82 is opened responsive to the pressure communicated through the pilot line 83. When the unloading valve opens, the discharge from the pump 14 is diverted through the recirculating line 81 and the unloading valve to the return line 34 through which the fluid flows back to the reservoir 33. At this point, only five pumps remain delivering hydraulic fluid into the discharge manifold continuing to raise the pressure in the manifold. As shown in FIG. 3, when the pressure of 1300 psi is reached and the pump 14 starts recirculating, the total delivery from the pumps into the discharge manifold immediately drops to approximately 200 gpm and the pressure begins rising with five pumps delivering into the discharge manifold. Since the pressure in the manifold exceeds the recirculating pressure of 1300 psi from the pump 14, the check valve 80 is the discharge line 75 from the pump prevents backflow of hydraulic fluid from the discharge manifold along the line 75 passed the check valve 80. The pressure continues rising with five pumps discharging until the level of 1600 psi is reached at which value the unloading valve 60 associated with the pump 12 is opened by the pressure in the pilot line 61 communicated to the pilot line up downstream from the check valve 55 in the discharge line 53 from the pump 12. As soon as the unloading valve 60 opens, the pump 12 begins recirculating through the line 54 and the unloading valve to the return line 34 and on back to the reservoir. The discharge rate of the four remaining pumps is now 157 gpm. The pressure again rises with four pumps discharging to the discharge manifold until the pressure is 2050 psi at which level the unloading valve for the pump 15 opens causing the pump 15 to recirculate leaving three pumps discharging 115 gpm to the discharge manifold. At 2800 psi, the unloading valve for the pump 13 opens recirculating the pump 13 leaving the pumps 11 and 20 discharging a total of 84 gpm to the discharge manifold. As indicated in FIG. 3, over the operating range of the combination of 4, 5, and 6 pumps discharging to the discharge manifold the approximate average horsepower available from the power pack is 225. With the pumps 11 and 20 operating delivering 84 gpm, the pressure rises to the level of 3250 psi at which the unloading valve for the pump 11 opens recirculating the pump 11 leaving only the pump 20 operating. With the single pump 20 discharging to the manifold 30, the pressure again rises to the level of 3500 psi at which the unloading valve for the pump 20 opens recirculating the pump 20 through the line 103 to the return line 34 and from the return line into the reservoir. At this point, all pumps are recirculating to the reservoir and the pressure within the discharge manifold 30 exceeds 3500 psi. It will be understood that as each pump is sequentially recirculated the check valve in the discharge line from the pump prevents backflow from the discharge manifold along the discharge line. With all of the pumps recirculating to the reservoir, leakage which occurs in the various valves in lines communicating with the discharge manifold is provided by the hydraulic fluid in the accumulator 32. When the pressure provided by the accumulator is depleted by the leakage to a level below 3500 psi, the pump 20 is again returned to the system because the lower pressure from the discharge manifold along the line 101 downstream from the check valve 102 is communicated through the pilot line 105 into the unloading valve 104. Since the unloading valve 104 is set to open at 3500 psi, a lower pressure allows the unloading valve to close. On the average, the unloading valves for all of the pumps reclose at a pressure level approximately ten percent below the opening pressure. Thus, when the pressure in the discharge manifold drops approximately ten percent below the level at which all of the pumps are recirculating, the unloading valve 104 closes forcing the hydraulic fluid being recirculated from the pump 20 to again flow along the discharge line 101 through the check valve 102 into the discharge manifold 30. The pressure will again build in the discharge manifold and the accumulator 32 until it rises above the 3500 psi level at which time the pump 20 will again recirculate to the reservoir. Thus, with the engine at normal operating speed, the pumps will automatically and sequentially discharge to the discharge manifold and recirculate to the reservoir as pressure demands require.

With the power pack 10 connected with the jack 180 shown in FIG. 2 and assuming the engine 25 is operating at normal speed and all pumps are ready to discharge to the manifold 30 and further assuming that the jack 180 is in a hydraulic workover unit connected with a full string of pipe in a well bore and the string of pipe is to be lifted from the well bore, the directional control valve 152 is operated by the lever 155 to direct hydraulic control fluid through one of the pilot lines 162 or 163 into the valve 31 of the power pack which is moved by the control fluid pressure to a position to communicate the discharge manifold 30 with the flexible tubing 183 leading to the line 190 which connects into the piston end of the jack 180. Presuming that the string of pipe is sufficiently heavy to require the maximum pressure available from the power pack and presuming that all of the lines are filled with hydraulic fluid, the pressure will remain sufficiently high that all of the pumps other than the pump 20 may be recirculating to the reservoir. Under such circumstances the load will be slowly lifted by the 31 gpm discharge from the pump 20 at the pressure which does not exceed 3500 psi. The hydraulic fluid operating the jack passes through the line 190 and the check valve 193 into the piston end of the jack lifting the piston and rod upwardly. The fluid in the rod end of the jack is displaced from the cylinder through the line 184. If the jack is being operated in normal, not the regenerative mode, the lever 205 on the valve 203 is positioned to communicate pilot pressure from the line 190 through the line 231 and the valve 204 into the pilot line 222 holding the counterbalance valve 195 open. The return fluid from the piston end of the jack in the line 184 cannot flow past the check valve 192 and therefore is diverted through the line 194 and the counterbalance valve into the return line 191 through which the return fluid flows through the flexible tubing 181 into the return line 34 of the power pack to the reservoir 33. Since there is no pressure in the line 184 upstream from the check valve 192, there is no pressure in the pilot line 201 so that the counterbalance valve 200 is closed. Similarly since the jack is not in the regenerative mode the valve 214 is closed so that all of the fluid delivered from the power pack through the line 190 must flow into the lower piston end of the jack. When the jack reaches the upper end of a complete stroke the traveling slips on the workover unit are disengaged and a joint of pipe is removed from the pipe string in accordance with the normal operating procedures of hydraulic workover units. At this point the jack must be returned downwardly to perform another lifting step. It will be apparent that if the downward stroke of the jack requires substantially less time than the lifting stroke, the total operating time of the workover unit for pulling a string of pipe from a well will be substantially reduced. The directional flow control valve 31 of the power pack is moved by means of the lever 155 on the valve assembly 153 shifting the position of the valve to direct hydraulic fluid into the rod end of the jack while returning the fluid from the piston end of the jack. The valve 31 is shifted to apply the hydraulic fluid pressure from the discharge manifold 30 into the flexible hose 182 through which the fluid flows into the line 184 into the rod end of the jack through the check valve 192. The pressure in the line 184 upstream from the check valve 192 is communicated through the pilot line 201 to the counterbalance valve 200 opening the counterbalance valve so that fluid returns from the lower piston end of the jack flow through the line 190 and the counterbalance valve 200 to the line 194 returning to the power pack through the line 191 which is connected through the flexible hose 181 to the power pack return line 34. Since the regenerative mode cannot be used in lowering the jack the lever 205 on the valve 204 is positioned to communicate the pilot line 222 leading to the counterbalance 194 with the line 224 back to the reservoir so that the counterbalance 195 is closed. Similarly the valve 214 which is used during the regenerative mode is closed. There is no pressure in the pilot line 212 to the valve 214 while pressure on the other side of the valve 214 is applied from the pilot line 201 in the pilot line 234 insuring that the regenerative valve 214 is closed. Thus, with no load on the jack and the weight of gravity tending to return the jack back downwardly minimum pressure is required to lower the jack so that the pressure required to pump hydraulic fluid into the rod end of the jack from the power pack discharge manifold 30 is so low, below 1300 psi as shown on FIG. 3, that the unloading valves of all of the pumps 11–15 and 20 are closed directing the total discharge of the pumps to the jack. The maximum power pack capacity of approximately 250 gpm is pumped into the rod end of the jack rapidly lowering the jack to the bottom end of the stroke. Thus it will be seen that the automatic control feature of the power pack responds to the pressure requirements for lowering the jack so that without any action on the part of the operator of the workover unit the six pumps of the power pack are immediately effective to discharge the full capacity of the power pack for rapid lowering of the jack.

As the pulling of the string of pipe progresses the jack is sequentially raised and lowered moving slowly upwardly and rapidly downwardly as the pumps are effected in relation to the pressure required to accomplish each step. As joints of pipe are removed from the pipe string the pressure applied into the jack to lift the jack becomes less. It will be recognized that the lifting force of the jack is calculated by the amount of pressure applied from the power pack over the effective downwardly facing surfaces of the piston of the jack. Thus a higher pressure provides more lifting force than a lower pressure. Therefore as the weight of the pipe string is reduced the pipe string may be lifted with a lower pressure. For example, when the weight of the pipe string permits it to be lifted below 3250 psi the lower pressure in the discharge manifold 30 effects the closing of the unloading valve 44 associated with the pump 11 so that both the pumps 11 and 20 are pumping at a total rate of 84 gpm. With the greater fluid input into the piston end of the jack the jack moves upwardly at a more rapid rate. When further pipe joints are removed lowering the pressure requirement for lifting the pipe string to 2800 psi, the unloading valve for the pump 13 closes so that the pumps 20, 11, and 13 are delivering 115 gpm into the jack further increasing the jack speed. Removal of the pipe joints continues as the pipe string is pulled sequentially bringing the pumps 15, 12 and 14 into operation so that during the last stages of pulling the pipe string all six pumps may be operating with a maximum input to the jack of 250 gpm thereby providing maximum speed and pulling rate. Each of these pump adjustments effectively adding a pump to the system and increasing the hydraulic fluid input to the system is automatically accomplished by virtue of the operation of the unloading valve for sequentially removing the pumps from the recirculating mode into the effective operating mode for lifting. Thus on each empty return stroke of the jack maximum jack speed is obtained by operation of all of the pumps and as the tubing string weight decreases the operating speed of the jack in pulling is sequentially increased as each pump is effectively brought into the system. At no time is it necessary for the operator of the workover unit to manipulate controls other than the levers 155 and 205 on the remote directional control valve assembly 153 and the regenerative speed select valve 203.

During the pulling of a tubing string where the load requirements permit it will be recognized that the use of the regenerative mode of operation of the jack further enhances the flexibility and speed of operation of the jack powered by the power pack of the invention. As previously stated the regenerative mode involves recirculating the hydraulic fluid from the rod end of the jack into the piston end of the jack during the lifting step. Thus with the lifting pressure being effective both above and below the piston the area of the piston available for the upward movement of the jack is reduced by the cross-sectional area of the rod. Thus with the capability of pumping a given amount of hydraulic fluid into the jack when the effective area over which the fluid acts is reduced, the speed of movement of the jack is correspondingly increased. Of course, for a given load the pressure required in the regenerative mode also is correspondingly increased. However, so long as the power pack is capable of delivering sufficient pressure at a given output it is possible to effectively increase the speed of the jack. The combination of the power pack of the invention provides greater flexibility and efficiency in operation than has been previously available. In the regenerative mode, referring to FIG. 2, the lever 205 on the valve assembly 203 is placed in the regenerative position which applies pressure through the pilot lines 210 and 212 and the valve 213 into the valve 214 opening the valve so that the rod and piston ends of the jack communicate through the line 215. Thus as hydraulic fluid pressure is applied through the line 190 into the piston end of the jack moving the jack upwardly, the hydraulic fluid in the other end of the jack around the rod above the piston is displaced through the line 184 into the line 215 through which the fluid flows into the line 190 where it joins the fluid flowing from the power pack to the piston end of the jack. The pressures in the piston and rod end of the jack are thus the same and therefore upward force is applied on the bottom of the piston over that area which is equal to the effective diameter of the rod. Since the rod end fluid is displaced into the piston end the additional fluid to lift the jack is reduced by a quantity equal to the volume displaced from the rod end. Thus a given amount of fluid into the piston end of the jack over a given period of time increases the lift speed of the jack. At the regenerative position of the lever 205 the pilot line 222 to the counterbalance valve 195 is vented to the reservoir and thus the counterbalance valve 195 is closed. Also, there is no pressure in the line 184 upstream from the check valve 192 so that there is no pressure in the pilot line 201 to the counterbalance valve 200. Thus the counterbalance valve 200 is closed. The flow therefore from the rod end of the jack is confined to return around through the line 215 to the piston end of the jack for the regenerative step. When the jack is placed in the regenerative mode it will be recognized that for a given load because the effective area of the piston is reduced, the pressure required to lift the jack will be correspondingly increased and thus it is possible that if the increase is sufficiently high the automatic features of the power pack of the invention may result in the number of pumps effectively operating the jack initially reducing. This, however, is automatic and as soon as the weight requirement drops additional pumps will be effective and the regenerative mode will further increase the speed of movement of the jack.

When running tubing into a well under pressure the force requirements vary from a maximum when the tubing is first inserted into the well to a minimum at the end of the operation when the weight of the tubing is sufficient to overcome the well pressure. Obviously the force requirements are directly related to the well pressure and to the weight of the tubing string being inserted. The power pack 10 of the invention is ideally suited to such a "snubbing" operating. When the tubing is first inserted into the well under pressure the highest force requirements are met by the power pack operating on as little as the one pump 20 at the maximum available operating pressure which in the example discussed herein ranges up to 3500 psi. At that pressure the rate of delivery of the hydraulic fluid to the workover unit is minimal and thus the rate at which the tubing may be pushed into the well is lowest. As the string of pipe increases in length and weight the force necessary to push the string into the well is reduced with increasing numbers of pumps effectively operating so that the rate of flow into the jack increases speeding up the rate at which the jack can push the tubing string into the well. Of course, on each return stroke when each new section of pipe is added to the string all of the pumps of the power pack are immediately effective to provide maximum return speed of the jack.

The power pack 10 is equally well suited to the operation of a hydraulic drilling unit which must force a pipe string downwardly as a drill bit on the lower end of the string drills a well bore. As the drilling progresses varying resistance is encountered in forcing the pipe downwardly placing changing demands upon the jack mechanism used to apply the downward force. As such changes occur the flexibility of the power pack permits more or less pumps to be effective as needed while providing a substantially constant power input to the jack over a wide range of operation. The automatic features of the power pack cause the pack to automatically adjust to the force demands without specific attention from the operator. After each joint of pipe is drilled downwardly the return of the jack upwardly is accomplished in a minimum time due to the automatic use of all of the pumps in the power pack for lifting the jack when it is not under a load.

As evident in FIG. 3, a power pack constructed in accordance with the invention using pumps of the capacities of the example discussed herein has a wide range of pressure and hydraulic fluid delivery capacities ranging from 31 gpm discharged by a single pump at a pressure up to 3500 psi to 250 gpm delivered by six pumps at pressures below 1300 psi. As the operating pressure required to accomplish the particular task being performed by the apparatus powered by the power pack varies, the power pack automatically adapts to the requirements. The full six pumps will deliver the 250 gallons at 1300 psi; five pumps deliver approximately 200 gallons at 1600 psi; four pumps deliver 157 gallons from 1600 psi to 2050 psi; three pumps discharge 115 gallons from 2050 psi to 2800 psi; two pumps deliver 84 gallons between 2800 psi and 3250 psi; and one pump delivers 31 gallons from 3250 psi to 3500 psi.

In running and pulling pipe in a well bore the extremes of power requirements encountered from initial full power at the beginning of an operation such as when pulling a full string of pipe to pulling the last joint of pipe involves variations of power requirements which prior art devices have been incapable of handling. Such extremes can be met by the present invention which effectively places in operation any number of pumps ranging from a single pump to the maximum in the power pack. All of the various well services involving running and pulling pipe whether the well is under pressure or not can readily be met by the power pack of the invention.

While the power pack has been described in terms of powering hydraulic workover units, it will be evident that it also may be used for any service involving the delivery of hydraulic fluid under pressure which requires varying pressures and flow rates. Further, it will be evident that while six pumps of different displacements have been described in the particular embodiment of the invention shown, fewer or more pumps may be included in the power pack and the capacities of the pumps may be varied as desired. It will be apparent that increasing the number of pumps will provide more increments in the available pressure changes and delivery capacities at such pressure between the minimum and maximum capabilities of the power pack.

What is claimed is:

1. A hydraulic power pack for supplying hydraulic fluid to hydraulic piston apparatus comprising: a plurality of positive displacement fixed output hydraulic pumps arranged to be driven simultaneously at a constant speed; a hydraulic fluid input manifold connected with the input ports of said pumps; a hydraulic fluid discharge manifold; a separate discharge line from the discharge port of each of said pumps to said discharge manifold; a check valve in each of said discharge lines to prevent hydraulic fluid flow from said discharge manifold along said discharge line toward said pump; a hydraulic fluid return line; a hydraulic fluid recirculating line connected into each of said discharge lines between said check valve in said discharge line and said pump connected with said discharge line leading to said return line; an unloading valve in each of said recirculating lines; a pilot line from each of said discharge lines between the check valve in said discharge line and said discharge manifold leading to said unloading valve in recirculating line connected into said discharge line for opening and closing said unloading valve responsive to hydraulic fluid pressure in said discharge line between said check valve and said discharge manifold; said unloading valves being set to respond at selected different discharge manifold pressures for sequentially discharging said pumps to said discharge manifold and recirculating said pumps to said return line over a range of combinations of discharge manifold flow rates and pressures; an accumulator connected into said discharge manifold; a dump pressure line; a vent line leading from each of said unloading valves and said recirculating line connected with said unloading valve upstream from said unloading valve into said dump pressure line; and a vent valve in each of said vent lines for venting each of said unloading valves to selectively open each of said unloading valves.

2. A hydraulic power pack in accordance with claim 1 including a shaft coupled with and adapted to operate said hydraulic pumps; a gear box connected with said shaft; and an engine connected with said gear box.

3. A hydraulic power pack in accordance with claim 2 wherein said unloading valves are set to discharge all of said pumps to said discharge manifold below a predetermined pressure value in said discharge manifold and to recirculate all of said pumps to said hydraulic fluid return line above a predetermined high pressure value in said discharge manifold.

4. A hydraulic power pack in accordance with claim 3 wherein said unloading valves are each set at different values for sequentially recirculating said pumps and discharging said pumps to said discharge manifold one pump at a time.

5. A hydraulic power pack in accordance with claim 4 wherein selected ones of said hydraulic pumps have different output values.

6. A hydraulic power pack in accordance with claim 5 wherein pairs of said pumps are of equal output values and each of said pairs has a different output value from each of the other of said pairs.

7. A hydraulic power pack in accordance with claim 6 wherein six hydraulic pumps are included.

8. A hydraulic power pack in accordance with claim 7 wherein said pumps are arranged in three sets of pairs of pumps.

9. A hydraulic power pack for supplying hydraulic fluid under pressure at selected combinations of pressure and output values to a hydraulically driven piston apparatus comprising: a plurality of positive displacement fixed output hydraulic pumps arranged in banks having common drive shafts for driving said pumps simultaneously at a constant speed; a gear box connected with said drive shafts; a constant speed engine connected with said gear box; a hydraulic fluid discharge manifold; a discharge line from the discharge outlet of each of said pumps to said discharge manifold; a check valve in each of said discharge lines between the discharge outlet of said pump connected with said line and said discharge manifold; a return line for returning hydraulic fluid to a supply reservoir; an inlet manifold connected with an inlet port of each of said pumps and adapted to be connected with said supply reservoir; a hydraulic fluid recirculating line connected with each of said discharge lines between the outlet of said pump connected with each said discharge line and said check valve in said discharge line and leading to said return line; an unloading valve in each of said recirculating lines for controlling flow through said recirculating line; a pilot line from each of said unloading valves into said discharge line connected with said unloading valve between said check valve in said discharge line and said discharge manifold for opening said unloading valve responsive to hydraulic fluid pressure in said discharge line downstream from said check valve; a hydraulic fluid dump pressure line adapted to be connected with said supply reservoir; a hydraulic fluid vent line from each of said unloading valves to said dump pressure line; a flow control valve in each of said vent lines; an accumulator connected with said discharge manifold; a two position flow control valve connected with said discharge manifold; two hydraulic fluid flow lines connected with said flow control valve for supplying hydraulic fluid through one of said lines and returning hydraulic fluid through the other of said lines through said flow control valve; and said unloading valves being set to discharge said pumps to said discharge manifold at different pressure values in stepped sequence to vary the number of pumps discharging to said discharge manifold and recirculating to said reservoir.

10. A hydraulic power pack in accordance with claim 9 wherein said unloading valves are set to discharge all of said pumps to said discharge manifold below a predetermined pressure value in said discharge manifold and to recirculate all of said pumps to said reservoir above a predetermined high pressure value in said manifold discharge.

11. A hydraulic power pack in accordance with claim 10 wherein said unloading valves are each set at different values for sequentially recirculating said pumps and discharging said pumps to said discharge manifold one pump at a time.

12. A hydraulic power pack in accordance with claim 11 wherein selected ones of said hydraulic pumps have different output values.

13. A hydraulic power pack in accordance with claim 12 wherein said pumps are arranged in selected pairs of equal output values and each of said pairs has a different output value from the other of said pairs.

14. A hydraulic power pack in accordance with claim 13 wherein six pumps are included arranged in two banks of three pumps each.

15. A hydraulic power pack in accordance with claim 1 wherein said unloading valves are held closed by a first fluid pressure and are opened by a second fluid pressure.

16. A hydraulic power pack in accordance with claim 9 wherein said unloading valves are held closed by a first fluid pressure and are opened by a second fluid pressure.

* * * * *